US006099111A

United States Patent [19]

Chang

[11] Patent Number: 6,099,111

[45] Date of Patent: Aug. 8, 2000

[54] INK JET RECORDING HEAD

[75] Inventor: Junhua Chang, Nagano, Japan

[73] Assignee: Seiko Epson Corporation, Tokyo, Japan

[21] Appl. No.: 09/012,213

[22] Filed: Jan. 23, 1998

[30] Foreign Application Priority Data

| | | | |
|---|---|---|---|
| Jan. 24, 1997 | [JP] | Japan | 9-011732 |
| Jul. 18, 1997 | [JP] | Japan | 9-194502 |
| Dec. 19, 1997 | [JP] | Japan | 9-314524 |
| Dec. 19, 1997 | [JP] | Japan | 9-365364 |

[51] Int. Cl.[7] ..... B41J 2/045

[52] U.S. Cl. ..... 347/71; 347/94

[58] Field of Search ..... 347/71, 94

[56] References Cited

U.S. PATENT DOCUMENTS 5,021,808 6/1991 Kohyama ..... 346/140 R

FOREIGN PATENT DOCUMENTS 6-40030 2/1994 Japan .
6-122197 5/1994 Japan .
9-187932 7/1997 Japan .

OTHER PUBLICATIONS

Patent Abstracts of Japan vol. 008, No. 180 (M–318), Aug. 18, 1984, & JP 59 070575 A (Toray KK) Apr. 21, 1984 *Abstract.

Patent Abstracts of Japan vol. 014, No. 010 (M–917), Jan. 10, 1989 & JP 01 257058 A (Seiko Epson Corp) Oct. 13, 1989 *Abstract.

Patent Abstracts of Japan vol. 012, No. 208 (M–709), Jun. 15, 1988 & JP 63 011354 A (Seiko Epson Corporation), Jan. 18, 1988 *Abstract.

Patent Abstracts of Japan vol. 013, No. 519 (M–895) Nov. 20, 1989 & JP 01 210351 A (NEC Corp) Aug. 23, 1989 *Abstract.

*Primary Examiner*—Arthur T. Grimley
*Assistant Examiner*—Greg Moddafsky
*Attorney, Agent, or Firm*—Sughrue, Mion, Zinn, Macpeak & Seas, PLLC

[57] ABSTRACT

An ink jet recording head is described in which nozzles can be arranged at a high density, which can be driven at a high frequency, and in which the nozzles do not interfere with each other.

An ink jet recording head is connected to a buffer tank via a communication path which is close to an ink flow path of the recording head and which elongates along the arrangement direction of the pressure generating chambers. Therefore, pressure variation due to a reverse flow from the pressure generating chambers is absorbed by the tank.

26 Claims, 12 Drawing Sheets

INK JET RECORDING HEAD

BACKGROUND OF THE INVENTION

1. Field of the Invention

The invention relates to an ink jet recording head in which ink of pressure generating chambers supplied with ink from a reservoir connected to an external ink tank is pressurized by piezoelectric vibrators or heating means and ink droplets are ejected from nozzle openings to form an ink image on a recording sheet.

2. Description of the Related Art

An ink jet recording head basically comprises: a reservoir connected to an external ink tank; a plurality of pressure generating chambers connected to the reservoir via an ink supply port; pressure generating means for pressurizing the pressure generating chambers, such as piezoelectric vibrators or heating means; and nozzle openings from which ink pressurized in the pressure generating chambers is ejected as droplets.

In such an ink jet recording head, as well known in the art, although ink which is pressurized in the pressure generating chambers is mainly ejected as droplets, part of the ink reversely flows to the reservoir for supplying the ink to the pressure generating chambers, via the ink supply port.

When the print density is suddenly changed and the ink consumption is largely varied, therefore, pressure vibration occurs in the reservoir which supplies the ink to the pressure generating chambers. This pressure vibration of the reservoir propagates to all the pressure generating chambers connected to the reservoir, so that also the pressure of the pressure generating chambers is varied, thereby affecting the ejection characteristics. In an extreme case, a crosstalk in which ink droplets are ejected irrespective of a print signal occurs.

This problem is easily produced particularly in an ink jet recording head which has 64 or more nozzle openings and which can be driven at a density of 180 dpi or more and a frequency of 20 kHz or higher.

In order to solve the problem, an ink jet recording head in which a plate wherein nozzle openings are opened, a member for forming a reservoir, and a plate member for forming pressure generating chambers are stacked is proposed in a Japanese patent publication (Kokai) No. HEI9-187932. In the proposed ink jet recording head, a recess which opens toward the pressure generating chambers is formed at a position opposed to the reservoir, to build a thin portion between the plate member for forming the reservoir, and the plate member for forming the pressure generating chambers. A part of the reservoir is absorbed by elastic deformation of the thin portion due to the pressure of ink which reversely flows from the pressure generating chambers.

According to this configuration, the pressure variation due to the ink which reversely flows from the pressure generating chambers can be absorbed as much as possible, and a crosstalk and the like can be prevented from occurring. However, the thin portion must be formed in the plate member. This produces problems such as that the structure and the production steps are complicated, and that it is difficult to provide sufficient compliance.

The invention has been conducted in view of these problems.

SUMMARY OF THE INVENTION

It is an object of the invention to provide an ink jet recording head in which pressure variation of a reservoir can be effectively damped without complicating the structure, thereby allowing the ink droplet ejection characteristics to be stabilized.

It is a second object of the invention to provide an ink jet recording head in which an elastic deformation region can be easily formed in an area which is equal to or larger than a projected area of a reservoir.

The ink jet recording head of the invention is configured by: a cavity forming plate in which pressure generating chambers in which ink is pressured by pressure generating means, and a communication path communicated with external ink supplying means are formed, the communication path being connected to the pressure generating chambers via ink supply ports; a nozzle plate which seals one of opening faces of the cavity forming plate and which has nozzle openings from which ink droplets are ejected; and a connecting plate which seals another opening face of the cavity forming plate and to which an ink outlet port of a tank is to be connected, the tank being communicated with the communication path and having a buffer function.

Since the connection of the ink tank having a buffer function is performed via the opening which is close to an ink flow path of the recording head and which elongates along the arrangement direction of the pressure generating chambers, the pressure of the ink which reversely flows from the pressure generating chambers can be absorbed by the tank, and a crosstalk can be prevented as much as possible from occurring without complicating the structure of the recording head, thereby allowing the ink droplet ejection characteristics to be stabilized.

DESCRIPTION OF THE PREFERRED EMBODIMENTS

Hereinafter, the invention will be described by illustrating its embodiments.

Figure 1:
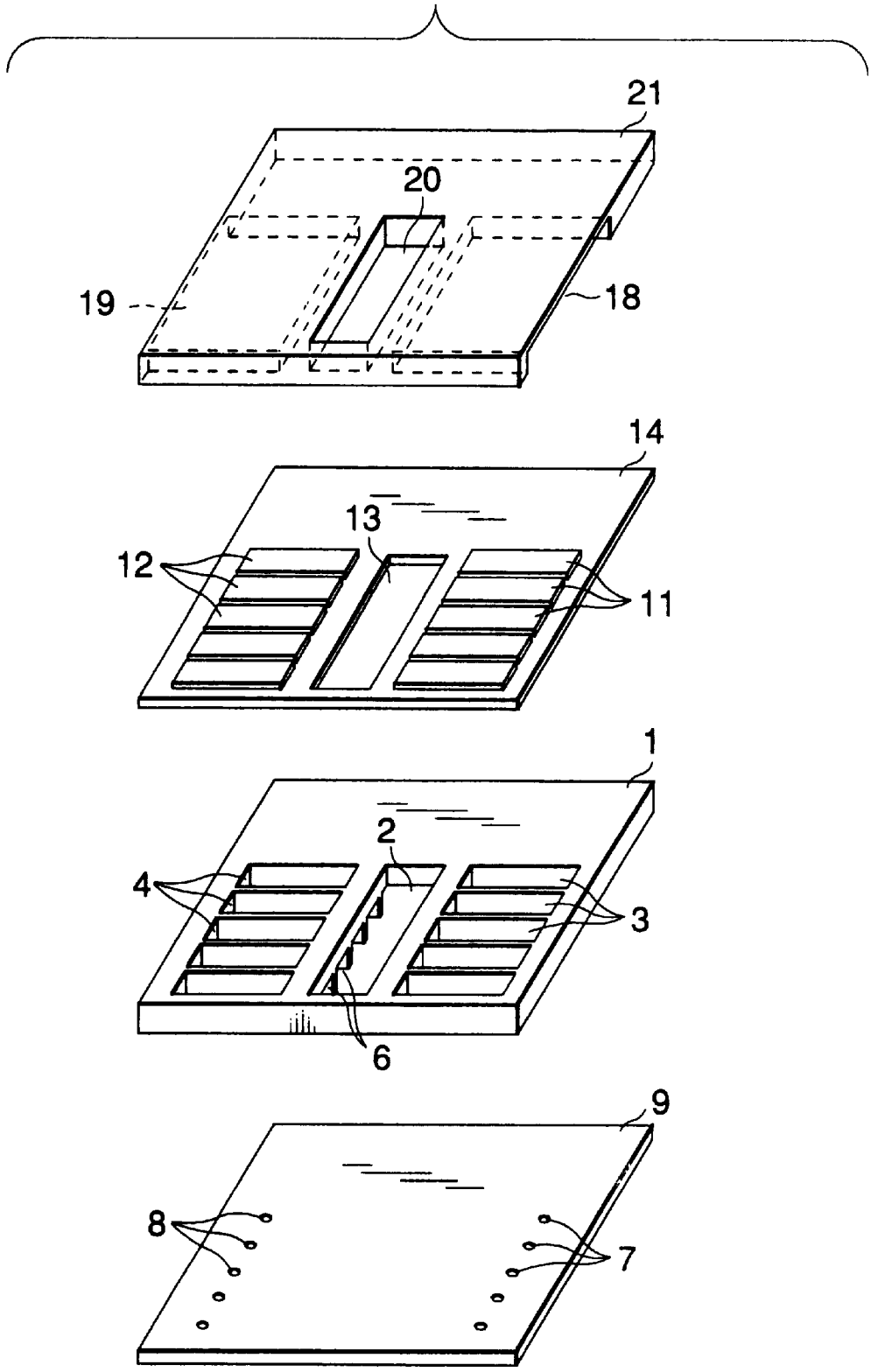
FIG. 1 is an exploded perspective view showing a first embodiment of the ink jet recording head of the invention.
Figure 2:
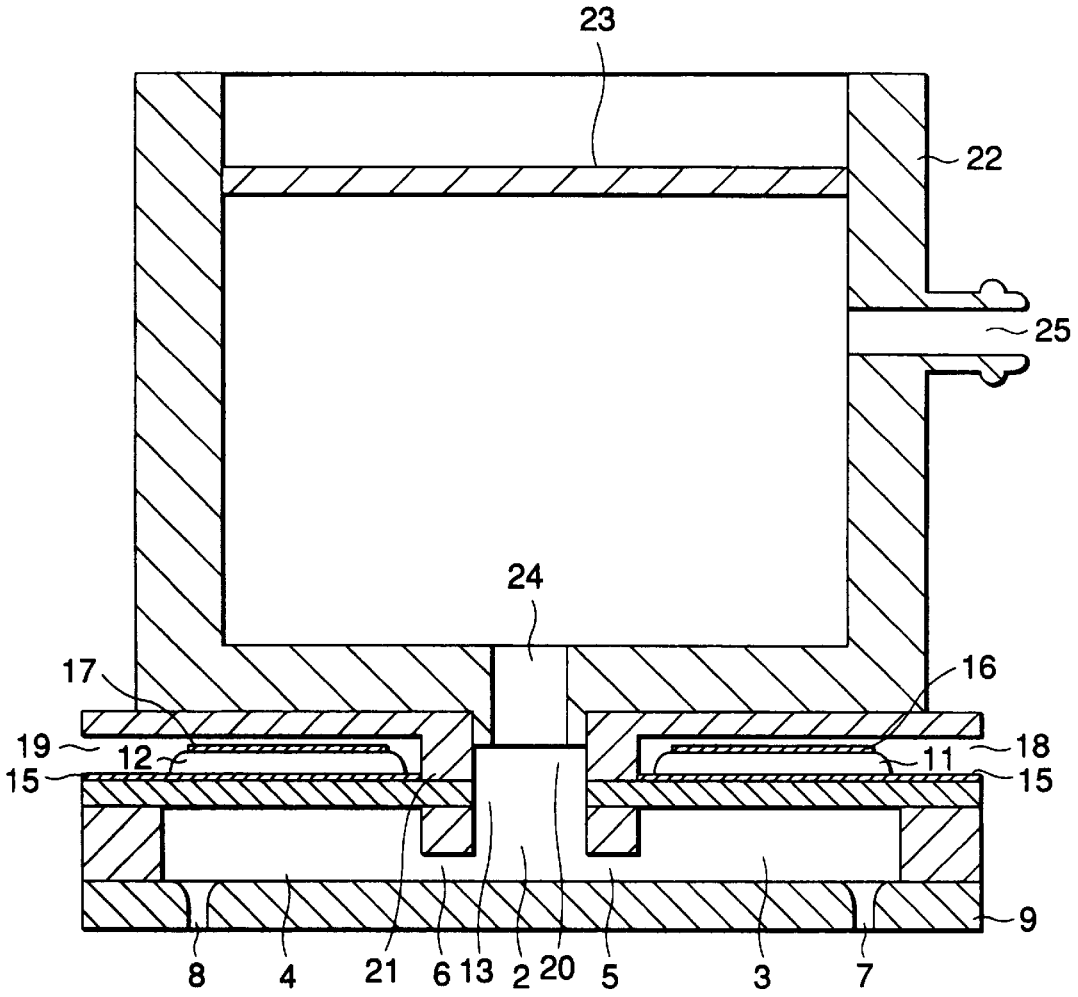
FIG. 2 is a section view showing the first embodiment of the ink jet recording head of the invention.

FIGS. 1 and 2 show a first embodiment of the invention. In the figures, the reference numeral 1 designates a cavity forming plate in which a communication path 2 that elongates along the center line so as to cover an arrangement area of pressure generating chambers 3 and 4, and the pressure generating chambers 3 and 4 that are symmetrical with each other about the communication path 2 are formed. Ink supply ports 5 and 6 through which the communication path 2 is connected to the pressure generating chambers 3 and 4 and which have a flow path resistance suitable for ink droplet ejection are formed between the communication path and the pressure generating chambers.

In the cavity forming plate 1, one of the opening faces is sealed by a nozzle plate 9 wherein nozzle openings 7 and 8 for ejecting ink droplets are formed in the regions opposed to the pressure generating chambers 3 and 4, and the other opening face is sealed by a cover member 14 wherein at least regions opposed to the pressure generating chamber 3 and 4 are elastically deformable by displacement of piezoelectric vibrators 11 and 12 and an opening 13 is formed in a region opposed to the communication path 2.

In the cover member 14, a lower electrode 15 is formed, and the piezoelectric vibrators 11 and 12 which perform deformation displacement are then respectively built in the regions opposed to the pressure generating chambers. Upper electrodes 16 and 17 to which a driving signal is selectively applied are formed on the surfaces of the piezoelectric vibrators 11 and 12.

A buffer tank 22 is connected to the upper face of the cover member 14 via a connecting plate 21 in which recesses 18 and 19 are formed and a through hole 20 is formed along the center line. The recesses are opened on the side of the piezoelectric vibrators and have a depth of a degree at which the displacement of the piezoelectric vibrators 11 and 12 is not impeded.

The buffer tank 22 is configured so that one of the faces constituting the tank (in the embodiment, the upper face 23) is elastically deformable by a pressure of ink. An ink outlet port 24 at the lower end is connected to the through hole 20. The tank can be connected to ink supplying means via a connection port 25.

In the embodiment, when the ink supplying means which is not shown, such as an ink cartridge is connected to the buffer tank 22, the nozzle plate 9 is sealed by a cap member, and a negative pressure is then applied to the nozzle openings 7 and 8, ink of the ink supplying means flows into the communication path 2, and then into the pressure generating chamber 3 and 4 via the ink supply ports 5 and 6, and thereafter flows out to the cap member via the nozzle openings 7 and 8.

This forced ink flow causes air bubbles trapped in the communication path 2 and also in the pressure generating chamber 3 and 4 to be exhausted to the outside.

At the time when the operation of charging the recording head with ink is completed in this way, the driving signal is applied to the piezoelectric vibrators 11 and 12. The piezoelectric vibrators 11 and 12 perform deformation displacement to pressurize the ink of the pressure generating chamber 3 and 4. The pressurized ink is ejected as droplets from the nozzle openings 7 and 8, and part of the pressurized ink reversely flows into the buffer tank 22 via the ink supply ports 5 and 6 and the communication path 2. When the pressure of the ink of the buffer tank 22 is raised by the reverse ink flow, the upper face 23 which has a large area, is elastically deformed, thereby suppressing the rise of the pressure of the ink as much as possible.

Even when the temperature is changed and a difference in thermal expansion occurs between the cavity forming plate 1 and the cover member 14, warpage due to the thermal expansion difference can be prevented from occurring, by forming the connecting plate 21 from a high-rigidity material which is substantially equal in coefficient of thermal expansion to the cavity forming plate 1.

Figure 3:
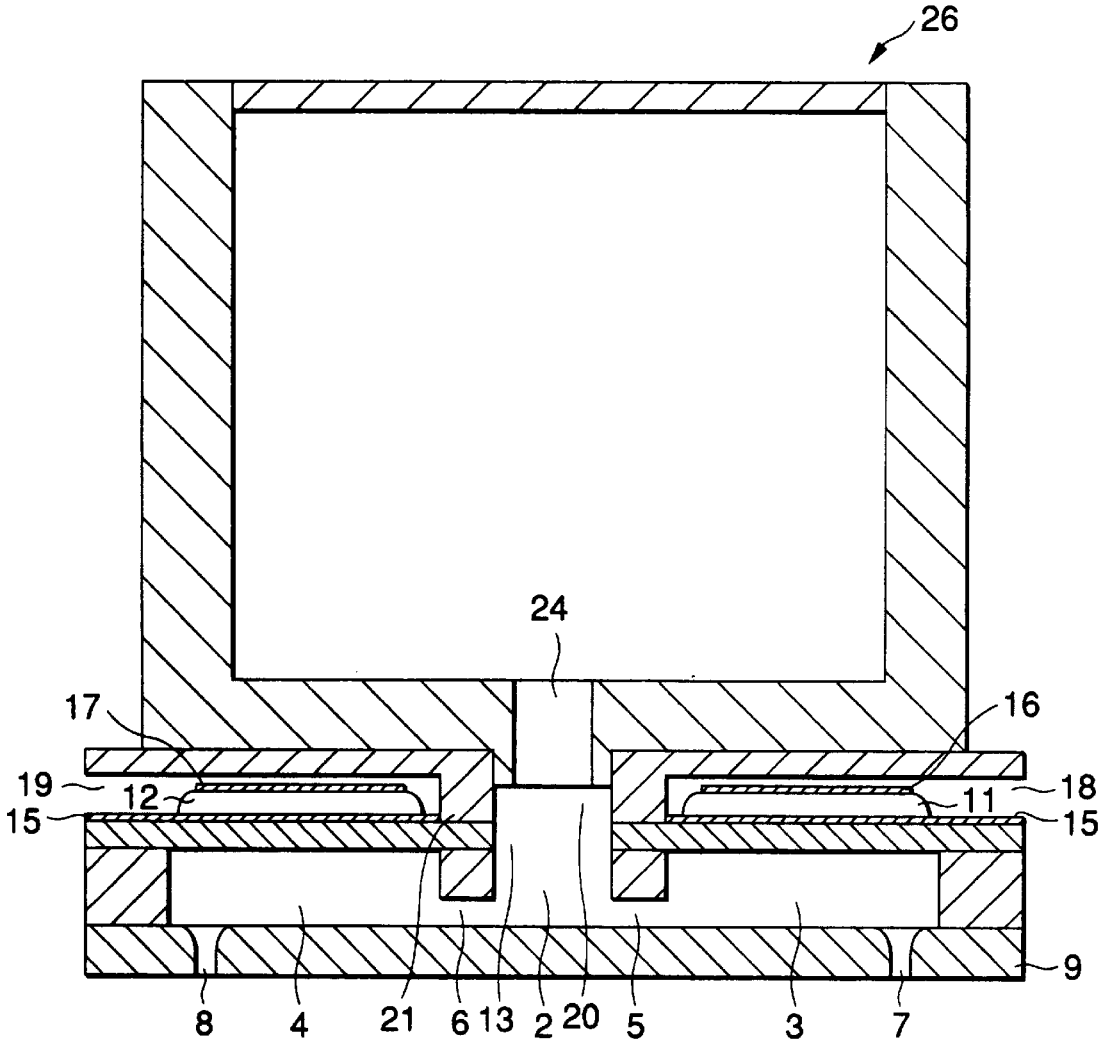
FIG. 3 is a section view showing an embodiment in which the invention is applied to a recording head suitable for a recording apparatus wherein an ink cartridge is mounted on a carriage.

In the embodiment described above, ink is supplied from the ink supplying means disposed in a case, via an ink supply tube. Also in the case where an ink cartridge 26 is detachably mounted on or fixed integrally with the recording head as shown in FIG. 3, the same effects can be attained.

Figure 4:
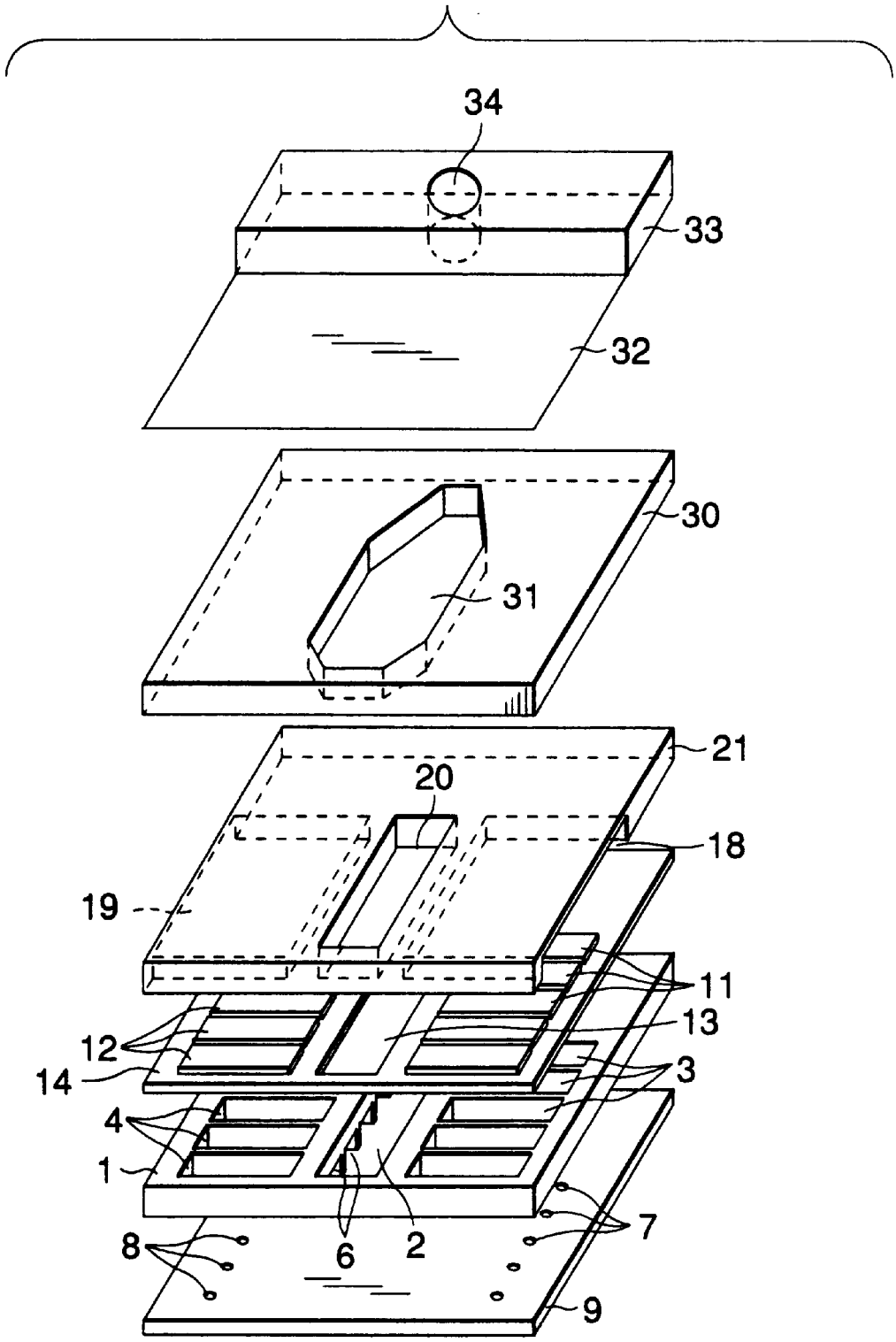
FIG. 4 is an exploded perspective view showing a second embodiment of the ink jet recording head of the invention.
Figure 5:
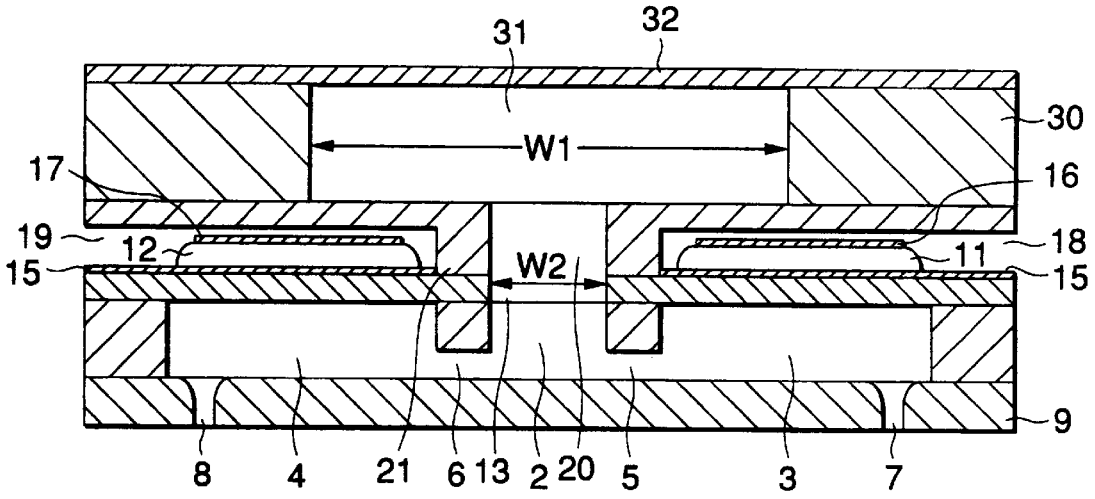
FIG. 5 is a section view showing the second embodiment of the ink jet recording head of the invention.

FIGS. 4 and 5 show a second embodiment of the invention. In the figures, the reference numeral 30 designates a reservoir forming substrate which is fixed to the upper face of the connecting plate 21, and in which a through hole serving as a reservoir 31 is formed. The through hole is extended to the regions where the piezoelectric vibrators 11 and 12 are formed, and is centered at the through hole 20 of the connecting plate 21. The width W1 of the reservoir 31 is larger than the width W2 of the through hole 20 of the connecting plate 21. Preferably, the edge of the through hole 31 is chamfered. At least the reservoir 31 is sealed by an elasticity applying plate 32 which is elastically deformable by pressure variation of the ink and made of a material of high airtightness.

In the elasticity applying plate 32, a thick portion 33 is formed in an end portion. An ink introducing port 34 which is communicated with the reservoir 31 and to which ink is supplied from an external ink vessel is formed in the thick portion 33.

In the embodiment, when the ink supplying means which is not shown, such as an ink cartridge is connected to the ink introducing port 34 through an ink flow path such as a tube, the nozzle plate 9 is sealed by a cap member, and a negative pressure is then applied to the nozzle openings 7 and 8, ink of the ink supplying means flows from the reservoir 31 into the communication path 2 of the cavity forming plate 1 via the through hole 20 of the connecting plate 21, and then into the pressure generating chamber 3 and 4 via the ink supply ports 5 and 6, and thereafter flows out to the cap member via the nozzle openings 7 and 8.

This forced ink flow causes air bubbles trapped in the reservoir 31 and the communication path 2 and also in the pressure generating chamber 3 and 4 to be exhausted to the outside.

At the time when the operation of charging the recording head with ink is completed in this way, the driving signal is applied to the piezoelectric vibrators 11 and 12. The piezoelectric vibrators 11 and 12 perform deformation displacement to pressurize the ink of the pressure generating chamber 3 and 4. The pressurized ink is ejected as droplets from the nozzle openings 7 and 8, and part of the pressurized ink reversely flows into the reservoir 31 via the ink supply ports 5 and 6. When the pressure of the reservoir 31 is raised by the reverse ink flow, the elasticity applying plate 32 which has a large area, is elastically deformed, thereby suppressing the pressure rise as much as possible.

Figure 6:
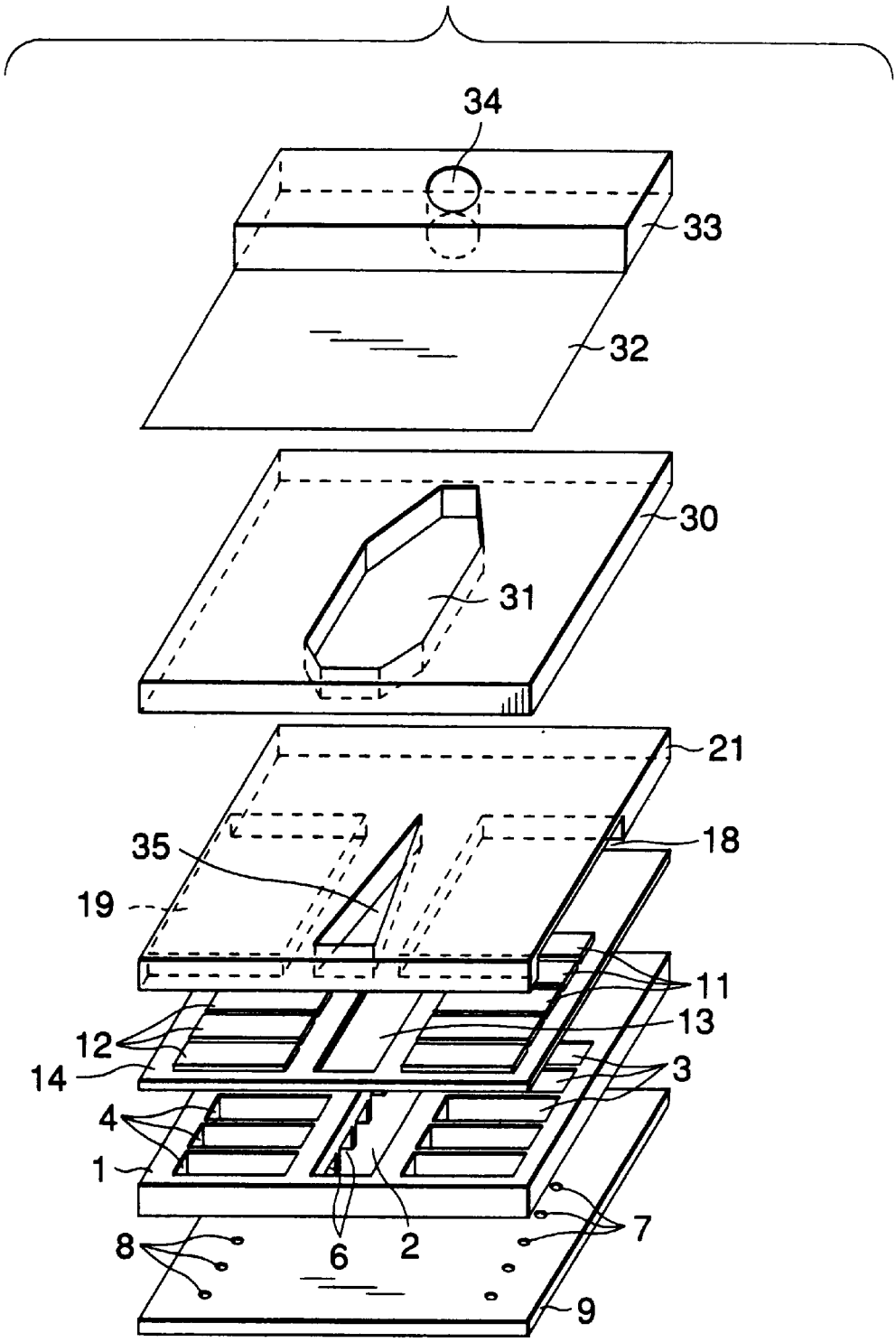
FIG. 6 is an exploded perspective view showing a third embodiment of the invention.

FIG. 6 shows a third embodiment of the invention. In the embodiment, the connecting plate 21 through which the reservoir forming substrate 30 is connected to the cavity forming plate 1 is formed in such a manner that a connection opening 35 of the plate has a section area which increases as the distance from the ink introducing port increases.

According to the embodiment, when the recording head is charged with ink of the ink supplying means by applying a negative pressure to the nozzle openings, or when air bubbles are eliminated from the recording head, the section shape of the connection opening 35 enables the ink flow rate in the reservoir to be constant irrespective of the distance from the ink introducing port 34. As a result, ink stagnation can be prevented from occurring and air bubbles in the reservoir 31 and the communication path 2 can be surely eliminated.

Figure 7A:
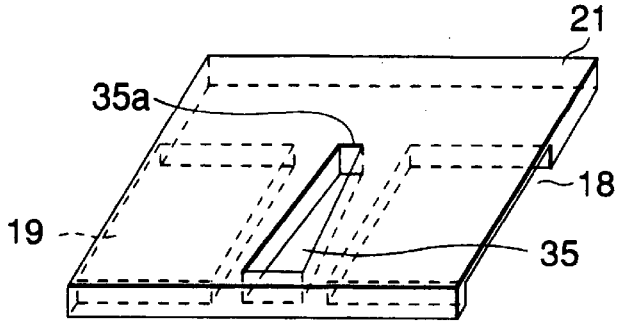
FIGS. 7(A) and 7(B) are views showing the structure of a connecting plate of variants on a fourth embodiment of the invention.
Figure 7B:
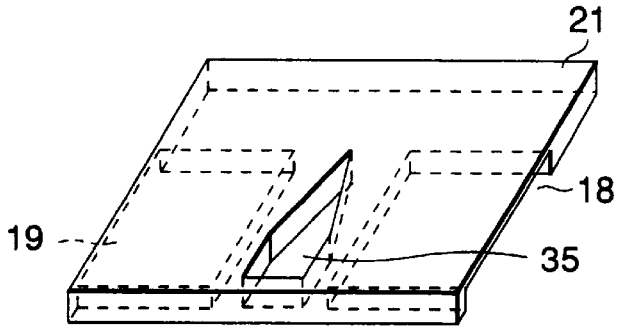

In the embodiment described above, the connection opening 35 of the connecting plate 21 is formed into a substantially triangular shape. Also, in the case where the tip end of the opening is eliminated so as to form a flat portion 35*a* as shown in FIG. 7(A), or where a rectangular connection opening 35' is formed at a region remote from the ink introducing port 34 as shown in FIG. 7(B), the same effects can be attained.

Figure 8:
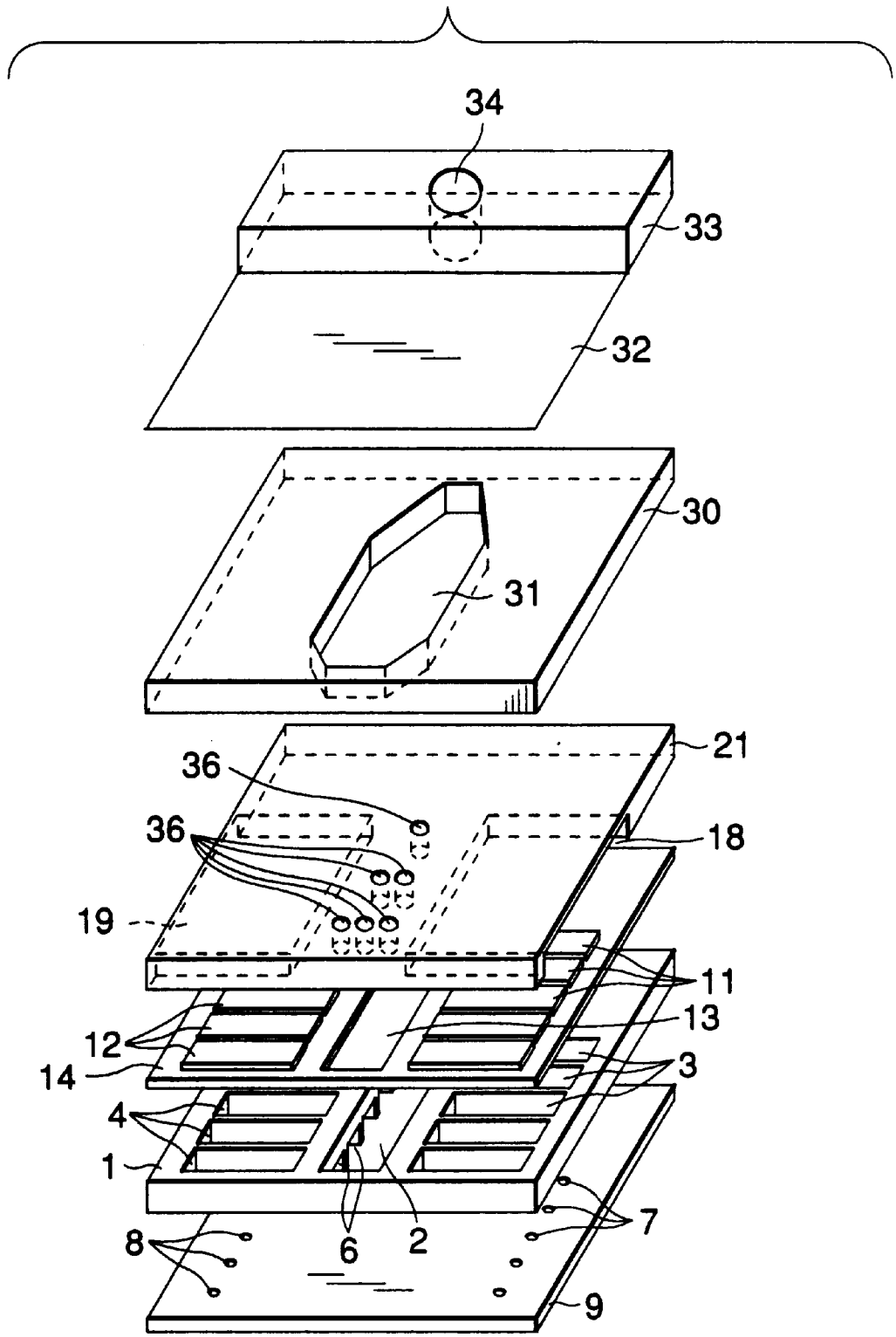
FIG. 8 is a view showing the structure of a connecting plate of a fifth embodiment of the invention.

FIG. 8 shows a fifth embodiment of the invention. In the embodiment, the opening for ink supply is configured by a plurality of openings 36. The number of the openings may be made larger as the distance from the ink introducing port 34 is larger.

Figure 9:
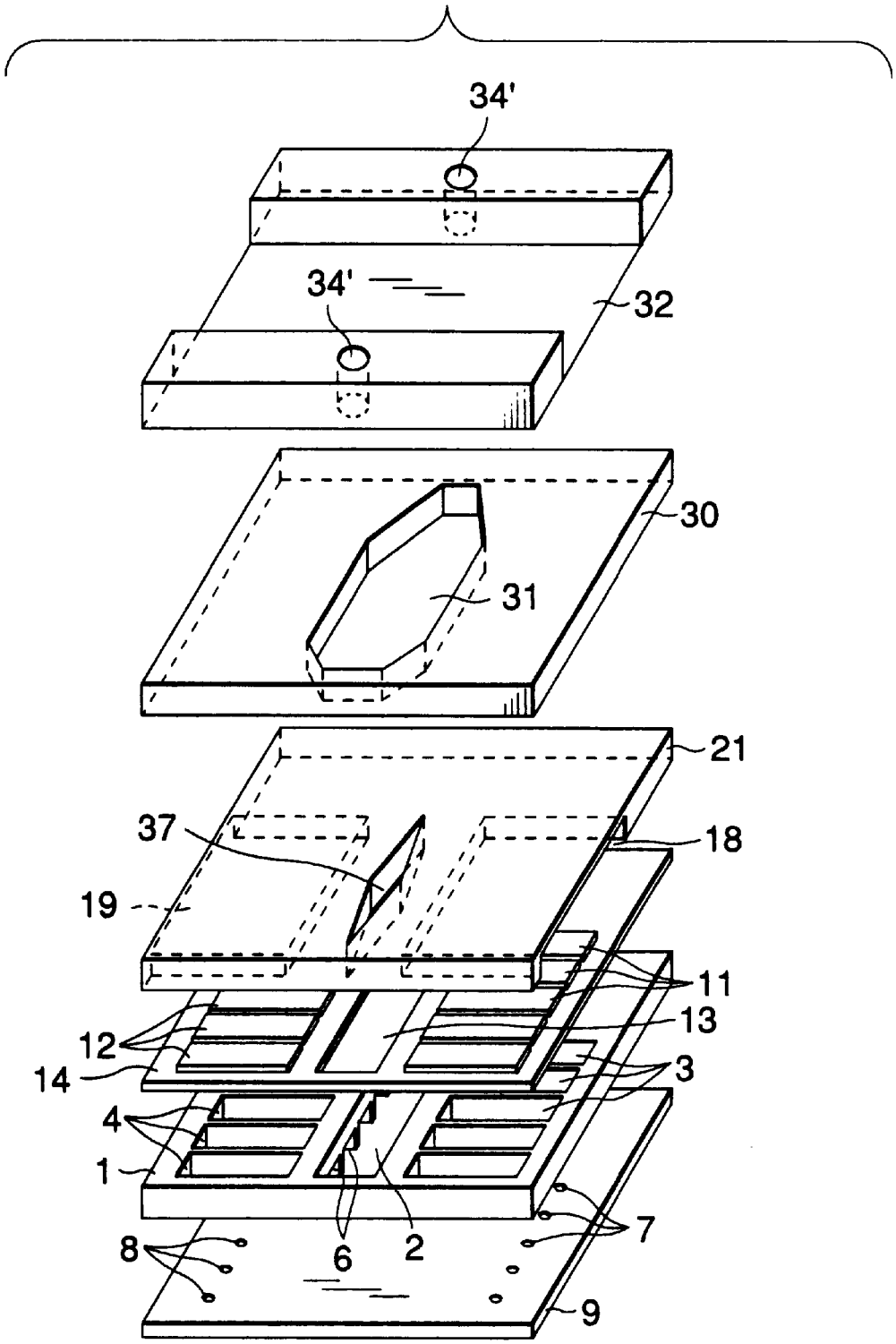
FIG. 9 is an exploded perspective view showing a sixth embodiment of the invention.

In the case where ink introducing ports 34' are respectively formed at both ends of the reservoir 31 as shown in FIG. 9, an opening 37 is preferably formed in such a manner that the section area on the side of each of the ends is made smaller, with setting the center portion of the reservoir 31 as a point of symmetry.

Figure 10A:
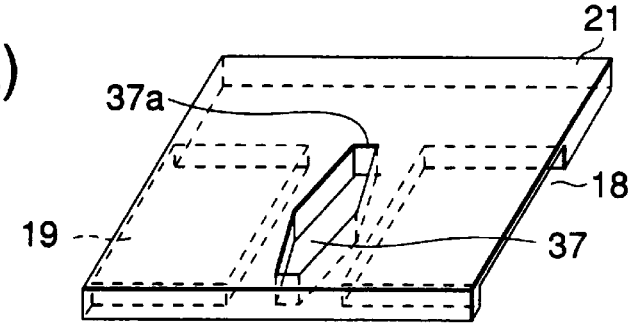
FIGS. 10(A) to 10(C) are views showing the structure of a connecting plate of variants of a seventh embodiment of the invention.
Figure 10B:
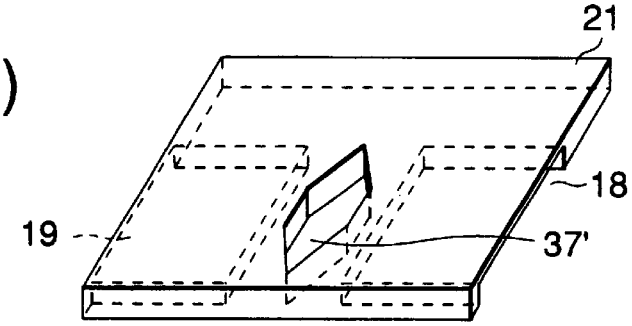
Figure 10C:
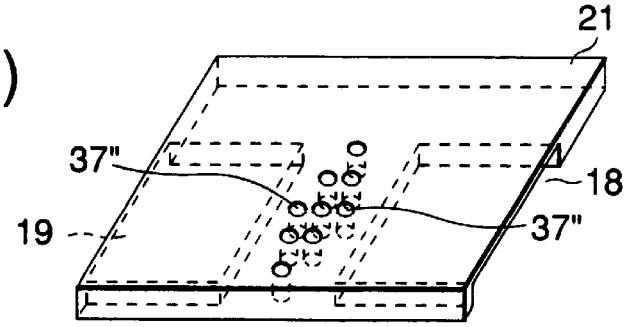

Also, in the configuration wherein the two ink introducing ports 34' are formed, even in the case where the connection opening 37 is formed in such a manner that both tip ends of the opening are eliminated so as to form flat portions 37*a* as shown in FIG. 10(A), that the center region of the connection opening 37' is rectangular and the end regions are triangular as shown in FIG. 10(B), or that a plurality of openings 37" are formed and the number of the openings is made larger as moving toward the center region in FIG. 10(C), the same effects can be attained.

When the nozzle openings are arranged at a high density and the ink consumption per unit time period is increased, the capacity of the reservoir 31 is inevitably enlarged in order to surely supply ink to the pressure generating chambers.

On the other hand, as well known in the art, ink is sucked from the nozzle openings by applying a negative pressure to the recording head while the nozzle openings are sealed by a capping member, in order to charge ink from the external tank into the recording head or eliminate air bubbles.

In such a suction process, when the reservoir 31 has a large capacity, the ink flow rate is lowered in a region of the reservoir 31 which is remote from the ink introducing port 34, and air bubbles may be trapped in the low-flow rate region.

It is difficult to discharge such bubbles from the nozzle openings.

Figure 11:
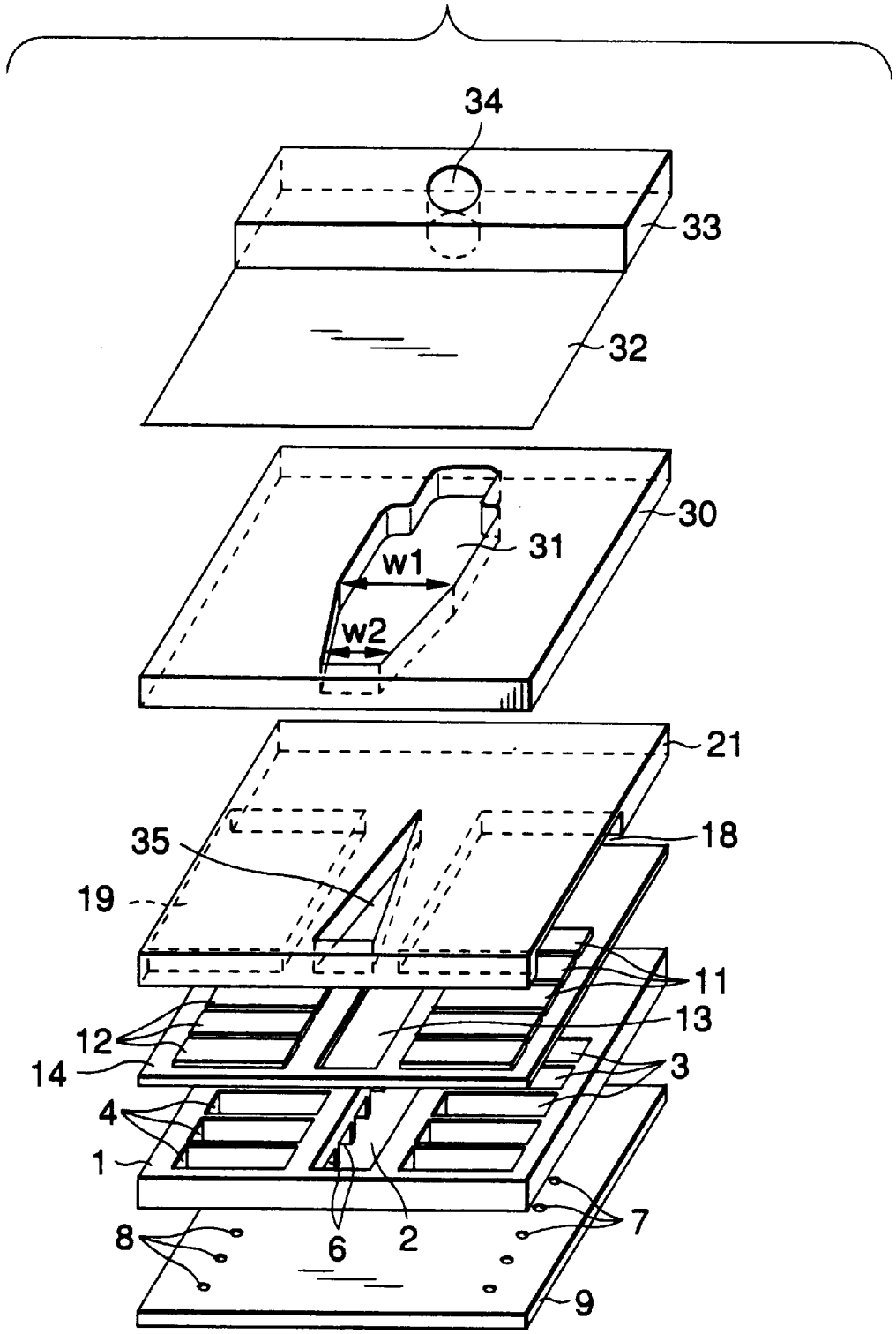
FIG. 11 is an exploded perspective view showing a eighth embodiment of the ink jet recording head of the invention.

FIG. 11 shows an eighth embodiment which can cope with such an inconvenience. In the embodiment, the reservoir 31 is configured so that the width w2 at a position largely remote from the ink introducing port 34 is narrowed so as to be smaller than the width w1 at a position closer to the ink introducing port 34. According to this configuration, the flow rate in the reservoir 31 can be evened to prevent air bubbles from being trapped in the reservoir.

Figure 12:
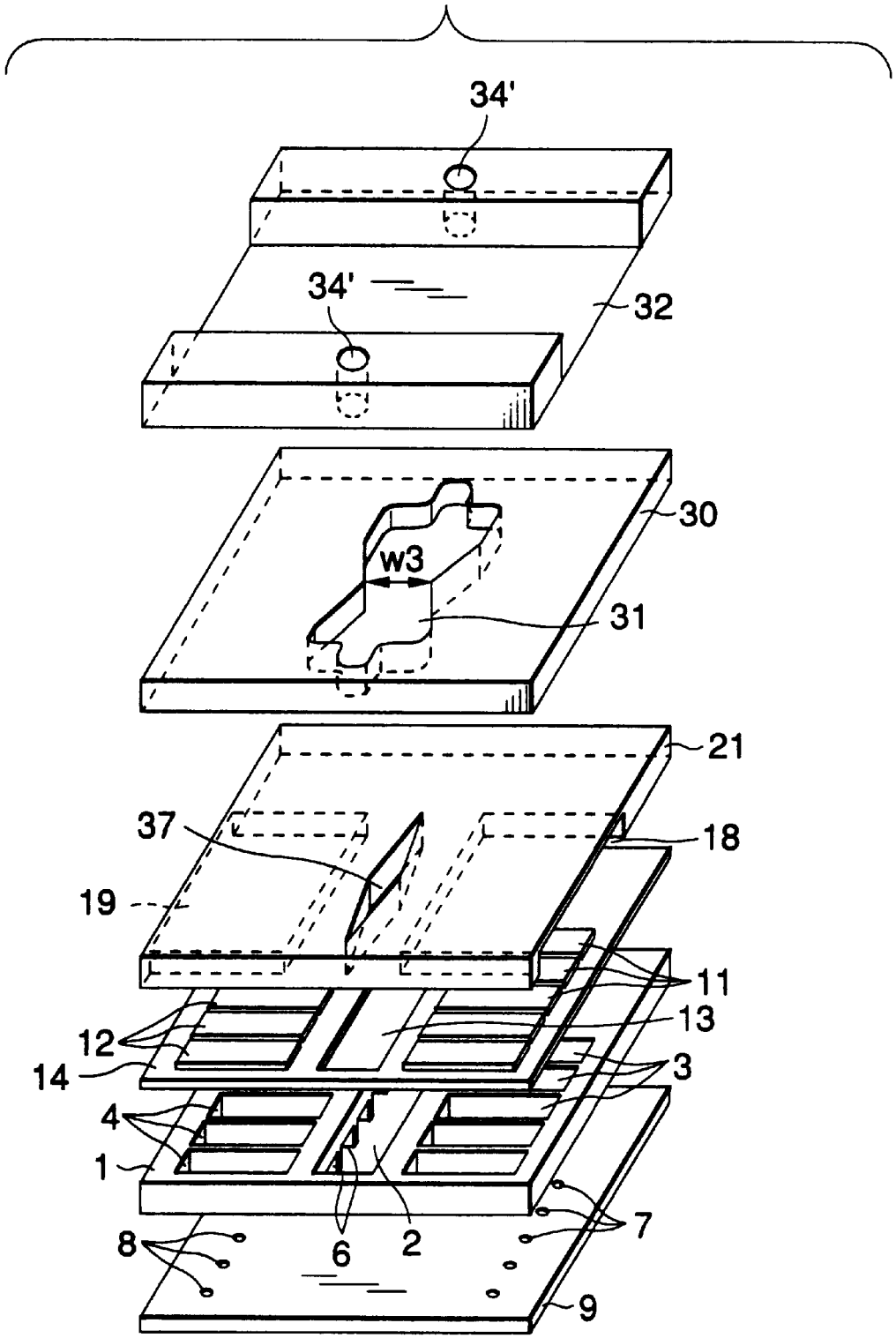
FIG. 12 is an exploded perspective view showing a ninth embodiment of the ink jet recording head of the invention.

In a recording head in which ink introducing ports 34' are respectively formed at both ends of the single reservoir 31, as shown in FIG. 12, the width w3 at a position which is most remote from the two ink introducing ports 34', i.e., the width of the center region may be formed so as to be smaller than the width at the ends. In this configuration also, the flow rate in a reservoir 31 can be evened to prevent air bubbles from being trapped in the reservoir.

In the embodiments described above, piezoelectric vibrators which perform deformation displacement are used as pressure generating means. It is apparent that the invention can be applied also to an ink jet recording head in which heating means that can be incorporated into a pressure generating chamber is used as pressure generating means.

Figure 13A:
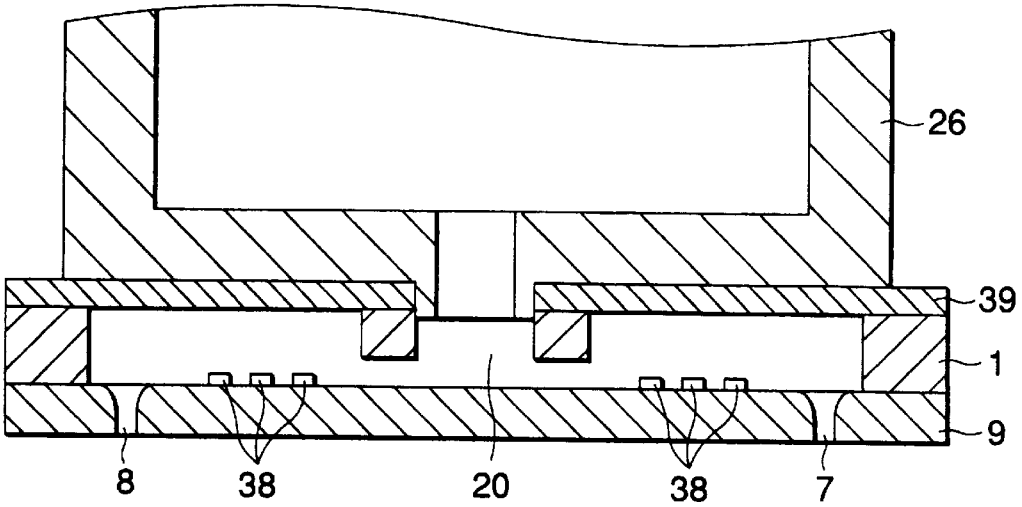
FIGS. 13(A) and 13(B) are views showing variants of a tenth embodiment in which the reservoir structure of the invention is applied to an ink jet recording head wherein heating elements are used as pressure generating means.
Figure 13B:
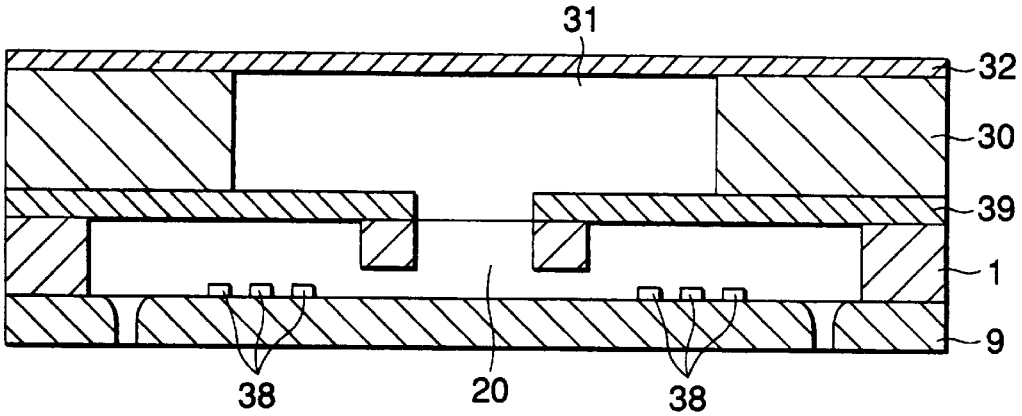

In a structure wherein heating elements 38 serving as pressure generating means are respectively incorporated into the pressure generating chambers in this way, the connecting plate 21 is not particularly required. As shown in FIGS. 13(A) and 13(B), therefore, the cavity forming plate 1 can be sealed by a connecting plate 39 in which the recesses 18 and 19 are not formed, whereby the structure can be simplified.

Figure 14:
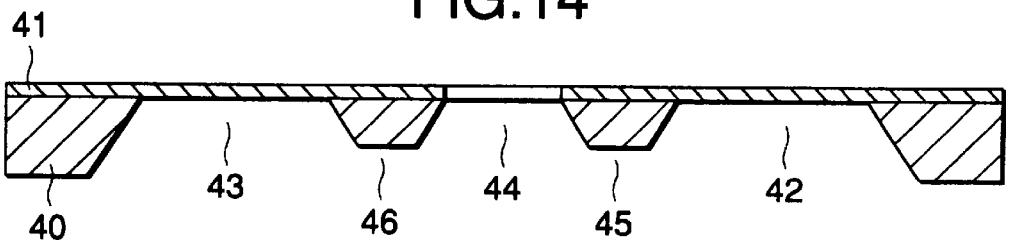
FIG. 14 is a view showing an eleventh embodiment in which the cavity forming plate and the cover member are configured by a single crystal silicon substrate.

In the embodiments described above, the cavity forming plate 1 and the cover member 14 are separately configured. Alternatively, the cavity forming plate and the cover member may be configured as a monolithic member in the following manner. First, a silicon oxide film 41 is formed on one face of a single crystal silicon substrate 40. An isotropic etching process is conducted on the other face until the silicon oxide film 41 to form pressure generating chambers 42 and 43 and a communication path 44 as shown in FIG. 14. Ink supply ports 45 and 46 are formed by a half etching process. The silicon oxide film in the region of the communication path 44 is then removed away by etching.

In the embodiments described above, the pressure generating chambers are arranged on both sides of the communication path 2. It is apparent that, even when pressure generating chambers are arranged on only one side of the communication path, the same effects can be attained.

What is claimed is:

1. An ink jet recording head comprising:

a cavity forming plate in which pressure generating chambers in which ink is pressured by pressure generating means, and a communication path communicated with external ink supplying means are formed, said communication path being connected to said pressure generating chambers via ink supply ports;

a nozzle plate which seals a first opening face of said cavity forming plate and which has nozzle openings from which ink droplets arc ejected; and a connecting plate which opposes a second opening face of said cavity forming plate and to which an ink outlet port of a tank is connected, said tank being communicated with said communication path and acting as a buffer by elastically deforming by pressure of said ink.

2. The ink jet recording head according to claim 1, wherein said pressure generating means comprises heating elements respectively incorporated into said pressure generating chambers.

3. The ink jet recording head according to claim 1, wherein said pressure generating means is configured by piezoelectric vibrators, said second opening face of said cavity forming plate is sealed by a cover member, at least a region of said cover member which is opposed to said pressure generating chambers being elastically deformable by displacement of said piezoelectric vibrators, and a recess is formed in said connecting plate, said recess having a depth of a degree at which the displacement of said piezoelectric vibrators is not impeded.

4. The ink jet recording head according to claim 3, wherein the cavity forming plate and the cover member are formed as a monolithic member.

5. An ink jet recording, head comprising:

a cavity forming plate in which pressure generating chambers in which ink is pressured by pressure generating means, and a communication path communicated with external ink supplying means are formed, said communication path being connected to said pressure generating chambers via ink supply ports;

a nozzle plate which seals a first opening face of said cavity forming p late and which has nozzle openings from which ink droplets arc ejected;

a connecting plate which opposes a second opening face of said cavity forming plate and which has a connection opening communicated with said communication path; and a reservoir forming substrate in which a through-hole serving as a reservoir is formed, said reservoir forming substrate which is connected to said connecting plate, and a surface of said reservoir forming substrate is sealed by an elasticity applying plate that is elastically deformable by a pressure change of ink, said elasticity applying plate having an ink introducing port into which said ink flows from outside of said ink jet recording head.

6. The ink jet recording head according to claim 5, wherein said pressure generating means comprises heating elements respectively incorporated into said pressure generating chambers.

7. The ink jet recording head according to claim 5, wherein said pressure generating means comprises piezoelectric vibrators, said second opening face of said cavity forming plate is sealed by a cover member, at least a region of said cover member which is opposed to said pressure generating chambers being elastically deformable by displacement of said piezoelectric vibrators, said cover member having an opening through which said communication path is connected to said reservoir, and a recess is formed in said connecting plate; said recess having a depth of a degree at which the displacement of said piezoelectric vibrators is not impeded.

8. The ink jet recording head according to claim 5, wherein a width of said reservoir is larger than a width of said connection opening.

9. The ink jet recording head according to claim 5, wherein a width of said reservoir is inversely proportionally to a distance between a point at which said width is measured and said ink introducing port is larger.

10. The ink jet recording head according to claim 5, wherein a section of said connection opening is made larger as a distance from said ink introducing port increases.

11. The ink jet recording head according to claim 5, wherein an end region of said connection opening is tapered.

12. The ink jet recording head according to claim 11, wherein a center region of said connection opening is rectangular in shape.

13. The ink jet recording head according to claim 5, wherein a tip end of an end region of said connection opening is eliminated to form a flat portion.

14. The ink jet recording head according to claim 5, wherein a region of said connection opening in a vicinity of said ink introducing port has a shape which is substantially rectangular.

15. The ink jet recording head according to claim 5, wherein a plurality of ink introducing ports are disposed in said elasticity applying plate.

16. The ink jet recording head according to claim 13, wherein said ink ports are disposed at ends of said connection opening.

17. The ink jet recording head according to claim 16, wherein a center region of said reservoir is narrowed.

18. The ink jet recording head according to claim 15, wherein end sections of said connection opening in a vicinity of said ink introducing ports are tapered.

19. The ink jet recording head according to claim 5, wherein said connection opening is formed by a plurality of through holes.

20. The ink jet recording head according to claim 19, wherein a number of said through holes is increased as a distance from said ink guiding port increases.

21. The ink jet recording head according to claim 19, wherein a majority of said plurality of said through holes are disposed toward the center region of the connecting plate.

22. The ink jet recording head according to claim 5, wherein the cavity forming plate and the cover member are formed as a monolithic member.

23. The ink jet recording head according to claim 5, wherein a region of said connection opening in a region remote from the ink introducing port has a shape which is substantially rectangular.

24. The ink jet recording head according to claim 5, wherein a width of said reservoir at a position remote from said ink introducing port is less than a width of said reservoir at a position close to said ink introducing port.

25. An ink jet recording head comprising:

a cavity forming plate in which pressure generating chambers in which ink is pressured by pressure generating means, and a communication path communicated with external ink supplying means are formed, said communication path being connected to said pressure generating chambers via ink supply ports;

a nozzle plate which seals a first opening face of said cavity forming plate and which has nozzle openings from which ink droplets are ejected and a connecting plate which seals a second opening face of said cavity forming plate and to which an ink outlet port of a tank is to be connected, said tank being communicated with said communication path and acting as a buffer by elastically deforming by pressure of said ink.

26. An ink jet recording head comprising:

a cavity forming plate in which pressure generating chambers in which ink is pressured by pressure generating means, and a communication path communicated with external ink supplying means are formed, said communication path being connected to said pressure generating chambers via ink supply ports;

a nozzle plate which seals a first opening face of said cavity forming plate and which has nozzle openings from which ink droplets are ejected;

a connecting plate which seals a second opening face of said cavity forming plate and which has a connection opening communicated with said communication path; and a reservoir forming substrate in which a through-hole serving as a reservoir is formed, said reservoir forming substrate which is connected to said connecting plate, and a surface of said reservoir forming substrate is sealed by an elasticity applying plate that is elastically deformable by a pressure change of ink, said elasticity applying plate having an ink introducing port into which said ink flows from outside of said ink jet recording head.

* * * * *

UNITED STATES PATENT AND TRADEMARK OFFICE

CERTIFICATE OF CORRECTION

PATENT NO.: 6,099,111
DATED: August 8, 2000
INVENTOR(S): Junhua CHANG

It is certified that error(s) appears in the above-identified patent and that said Letters Patent is hereby corrected as shown below:

[30] Foreign Application Priority Data:

Please delete the third priority data: and insert

October 30, 1997 [JP] Japan 9-314524

Signed and Sealed this

First Day of May, 2001

*Attest:*

Nicholas P. Godici

NICHOLAS P. GODICI

*Attesting Officer*

*Acting Director of the United States Patent and Trademark Office*